United States Patent [19]

Willis

[11] 3,967,077

[45] June 29, 1976

[54] APPLIANCE TIMER SWITCH ASSEMBLY

[75] Inventor: Thomas G. Willis, Raleigh, N.C.

[73] Assignee: Westinghouse Electric Corporation, Pittsburgh, Pa.

[22] Filed: Aug. 2, 1974

[21] Appl. No.: 494,681

[52] U.S. Cl. ..... 200/38 FA

[51] Int. Cl.[2] ..... H01H 43/00

[58] Field of Search ..... 200/38 R, 38 A, 38 F, 200/38 FA, 38 FB; 310/83; 58/9, 19 R, 38 R, 125 C

[56] References Cited

UNITED STATES PATENTS

| | | | |
|---|---|---|---|
| 2,993,099 | 7/1961 | Doyle | 200/38 FA |
| 3,038,041 | 6/1962 | Zagorski | 200/38 FA |
| 3,098,131 | 7/1963 | Gallagher et al. | 200/38 FA |
| 3,124,668 | 3/1964 | Zagorski et al. | 200/38 FA |
| 3,440,370 | 4/1969 | Willis et al. | 200/38 FA |
| 3,564,310 | 2/1971 | Willis | 310/83 |
| 3,581,026 | 5/1971 | Losert | 200/38 R |
| 3,686,450 | 8/1972 | Willis | 200/38 FA X |
| 3,712,966 | 1/1973 | Watts et al. | 200/38 FA X |
| 3,729,601 | 4/1973 | Yokoyama et al. | 200/38 R |

*Primary Examiner*—James R. Scott
*Attorney, Agent, or Firm*—C. L. McHale

[57] ABSTRACT

Timer suitable for the automatic control of appliances. The timer includes a contact structure which is activated by a rocking lever and two adjustment shafts which move the rocking lever when the shafts are manipulated to set the starting and stopping times of the timer. The rocking lever is maintained in the necessary position for manual operation of the applicance by the cooperation of a locking lever, an ear extending from the rocking lever, and an opening in the plate which supports the rocking lever. The locking lever covers the opening and prevents the penetration of the ear therein when the timer is set for manual operation. With this arrangement, the shafts are free to rotate according to the correct time.

7 Claims, 12 Drawing Figures

APPLIANCE TIMER SWITCH ASSEMBLY

BACKGROUND OF THE INVENTION

1. Field of the Invention

This invention relates, in general, to automatic switches and, more specifically, to appliance timers such as those suitable for electric ranges.

2. Description of the Prior Art

Timers are used frequently on major appliances to control their starting time and the duration of their operation. When used with ranges and ovens, such timers usually automatically control the time at which cooking begins and stops. Such timers must be reliable commensurate with a reasonable cost of manufacturing such items. U.S. Pat. Nos. 3,038,041, 3,440,370, 3,686,450, and 3,712,966 disclose timers which are of the type suitable for automatically controlling an electric range.

Many applicance timers have at least two shafts which may be moved to set the starting and stopping times for automatic operation. In one such prior art arrangement, the shafts move a rocking lever which in turn opens and closes the electrical contacts of the timer. One shaft is used to place the timer in a manual position for nonautomatic operation of the appliance. When in the manual position, one end of the rocking lever is held in a raised position to maintain closure of the switch contacts. The rocking lever is held in this position by a locking lever which holds one of the shafts in a raised or inward position against the rocking lever. Thus, according to this prior art arrangement, one shaft must be maintained in a particular position to permit manual operation of the associated appliance.

When using one of the shafts to hold the rocking lever as taught by the prior art, the position of the shaft becomes critical. The shaft which sets the switch for manual control must be held inward to hold the rocking lever in the desired position. Due to the construction of this type of timer, the indicating pointer attached to this shaft will not point to the correct time since it cannot be rotated by a motor-driven gear mechanism when in the inward position. Consequently, confusion and misinterpretation of the time settings is possible. Therefore, it is desirable, and it is an object of this invention, to provide an appliance timer in which both the starting and stopping shafts can rotate automatically according to the correct time when the timer is set for manual operation.

SUMMARY OF THE INVENTION

There is disclosed herein a new and useful timer which is suitable for use with appliances such as ranges and ovens. The timer is controlled by a starting shaft and a stopping shaft which are initially adjusted manually to program the starting and stopping times for the automatic operation. The shafts extend through a supporting plate and are positioned for engagement with respective ends of a rocking lever. Depending on the position of the shafts, the rocking lever acquires an orientation which either opens or closes the electrical contacts of the timer. A motor-driven gear mechanism cooperates with gears attached to the shafts to provide the timed motions necessary to operate the timer when set in the automatic mode of operation.

When the timer is set in the manual mode of operation, the rocking lever is held in the necessary position for contact closure regardless of the motion of the motor-driven gear mechanism. The rocking lever includes an ear which extends therefrom and which is positioned to project through an opening in the supporting plate when the end of the rocking lever near which the ear is attached is in close proximity to the supporting plate. When the ear remains out of the opening, the rocking lever maintains a position which keeps the contacts closed. A locking lever moves across the opening when the shaft is pushed for manual operation. With the locking lever blocking the opening in the supporting plate, the ear on the rocking lever must remain above the plane of the opening and the rocking lever maintains a position which keeps the contacts closed. With this arrangement, the shaft which is pushed to set the timer for manual operation may be retracted and engaged with the motor-driven gear mechanism to permit rotation of the shaft according to the correct time.

BRIEF DESCRIPTION OF THE DRAWING

Further advantages and uses of this invention will become more apparent when considered in view of the following detailed description and drawing, in which.

DESCRIPTION OF THE PREFERRED EMBODIMENTS

Figure 1:
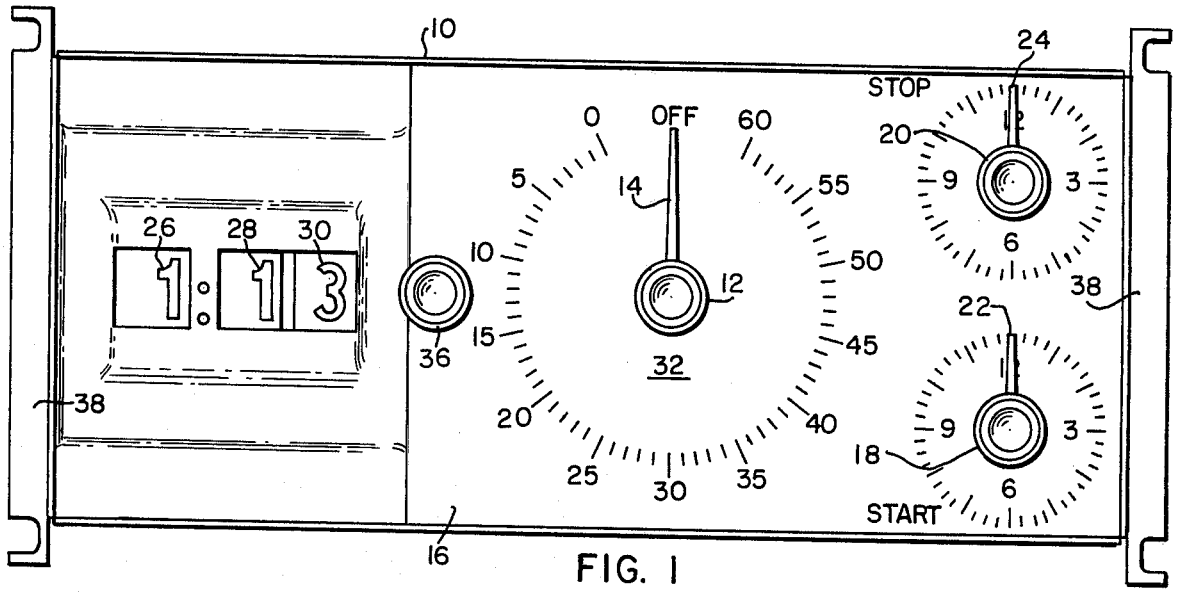
FIG. 1 is a front view of an appliance timer constructed for horizontal mounting according to this invention.

Throughout the following description, similar reference characters refer to similar elements or members in all of the figures of the drawing.

Referring now to the drawing, and to FIG. 1 in particular, there is shown a front elevational view of an appliance timer 10 constructed according to one specific embodiment of this invention. The timer 10 includes a control knob 12 which may be manipulated to rotate the pointer 14 and some of the internal components of the timer. The components associated with the knob 12 provide the elapsed time indicating feature, or "minute minder," of the timer 10. For example, when the pointer 14 is set at the 30-minute mark on the timer face 16, the pointer 14 will rotate clockwise with the passage of time. After the timer has rotated almost 180° to the zero position, a buzzer energizes which indicates that 30 minutes have elapsed since the pointer 14 was set. The buzzer is deenergized by manually rotating the knob 12 slightly in a clockwise direction to the OFF position. If the timer 10 is installed on a range or oven, the elapsed time indicating feature of the timer 10 is normally used to provide a signal when a substance has been cooking for a predetermined length of time.

The timer 10 also includes the knobs 18 and 20 which are used to manipulate associated components to close and open an electrical circuit at predetermined times. For automatic operation, each of the pointers 22 and 24, along with their associated internal components, is set to a predetermined time mark on the timer face 16. When the actual time equals the time indicated by the pointer 22, the electrical circuit is closed. When the actual time equals the time indicated by the pointer 24, the electrical circuit is opened. If the timer 10 is installed on a range or oven, the time between the "start" and "stop" settings normally equals the length of time the appliance is turned on for cooking.

The digital clock characters 26, 28 and 30 display the actual time, or "time-of-day," and are coupled to the elapsed time indicator 32 and to the start-stop control 34. The knob 36 provides a means for setting the characters of the clock to indicate the correct time. The shaft to which the knob 36 is attached is constantly engaged with the gear train which drives the clock. This shaft rotates at one revolution per minute and could be used to indicate the seconds between minute characters with a suitable hand attached to the shaft. The notched brackets 38 are used to mount the timer 10 in the appliance it is associated with.

Figure 2:
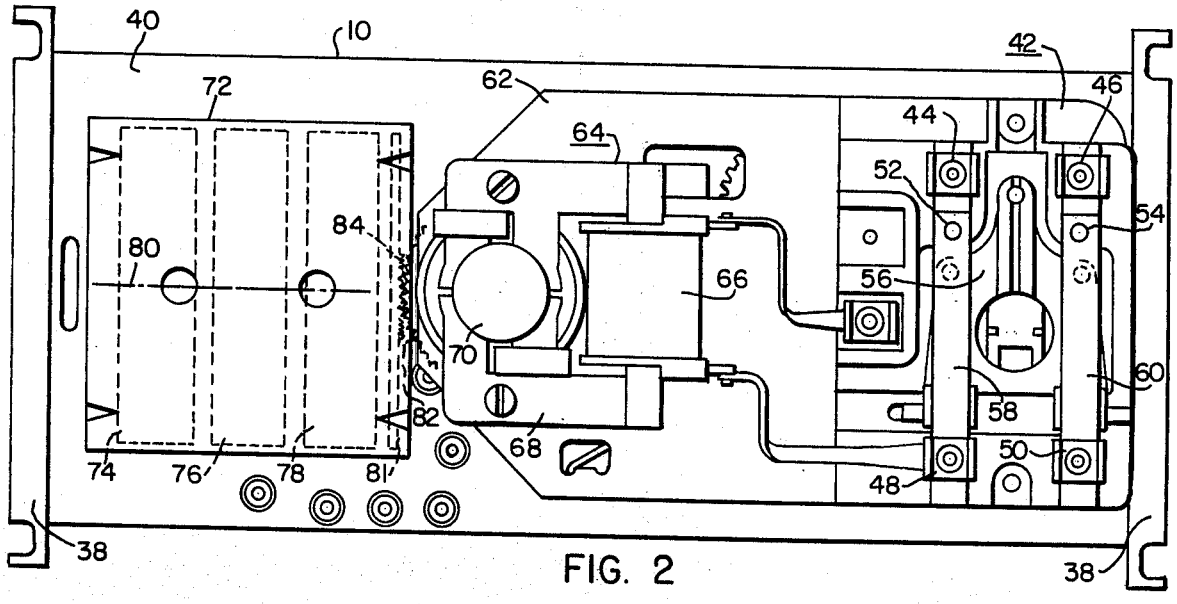
FIG. 2 is a back view of the appliance timer shown in FIG. 1.

FIG. 2 is a back elevational view of the appliance timer 10. The timer components illustrated in FIG. 2 are attached to the supporting plate 40, which is located behind the timer face 16 shown in FIG. 1. The electrical circuit controlled by the timer 10 is connected to the dual-pole single-throw switch 42. The load is connected to the stationary terminals 44 and 46, and the energizing electrical power is connected to the terminals 48 and 50 which are connected to the movable contacts 52 and 54. The contacts 52 and 54 are separated from the terminals 44 and 46 when the switch 42 is opened by the switch operator 56 which pivots to raise the contact arms 58 and 60. U.S. Pat. Nos. 3,440,370, 3,686,450, and 3,712,966 disclose timers which have an electrical switch similar to the switch 42 of this invention. These patents, together with U.S. Pat. No. 3,038,041, may be referred to for additional descriptions of similar elements and members of the timer 10.

The switch 42 is mounted to the supporting plate 62 which is mounted to the supporting plate 40. Various mechanical members are located between the plates 40 and 62 as will be discussed hereinafter. The supporting plate 62 also supportss the synchronous motor 64 which consists generally of the winding 66, the magnetic core 68, and the sealed rotor assembly 70. The rotor assembly 70 is coupled to various timer components through networks of gears and clutches to drive the components at the correct time and velocity.

The clock display subassembly 72 is mounted directly to the supporting plate 40 and houses the disc 81 and the cylinders 74, 76, and 78 which have the necessary numerical characters displayed on their outer surfaces. The disc and cylinders revolve around the axis 80 and are interconnected by a special gear arrangement which is known by those skilled in the art for turning successive cylinders properly in relation to time. The input motion to the display subassembly 72 is provided by the gear 82 which engages a circular rack of teeth 84 on the disc 81. The modular construction of the display subassembly 72 is advantageous also when mounting the appliance timer 10 in a vertical direction rather than in a horizontal direction for which the timer illustrated in FIGS. 1 and 2 is constructed. When mounted vertically, the numerical characters of the display subassembly 72 should still be oriented horizontally for conventional reading. Thus, the characters must be rotated 90° with respect to the supporting plate 40.

Figure 3:
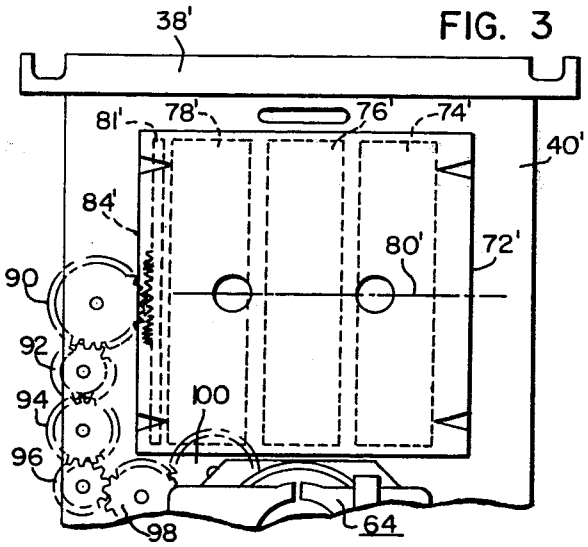
FIG. 3 is a partial back view of an appliance timer constructed for vertical mounting according to this invention.

FIG. 3 is a partial view of an appliance timer constructed for vertical mounting. The numerical characters remain horizontally oriented by rotating the display subassembly 72′ 90° before mounting it to the supporting plate 40′. The gears 90, 92, 94, 96, 98 and 100 provide a gear train between the rack 84′ and the motor 64 for driving the disc 81′ and the cylinders 74′, 76′ and 78′. The display subassemblies 72 and 72′ are identical, thus a versatile timer can be constructed for either vertical or horizontal mounting without requiring different display subassemblies. The gears 90, 92, 94, 96, 98 and 100 normally would not be included in timers built for only horizontal mounting.

Figure 4:
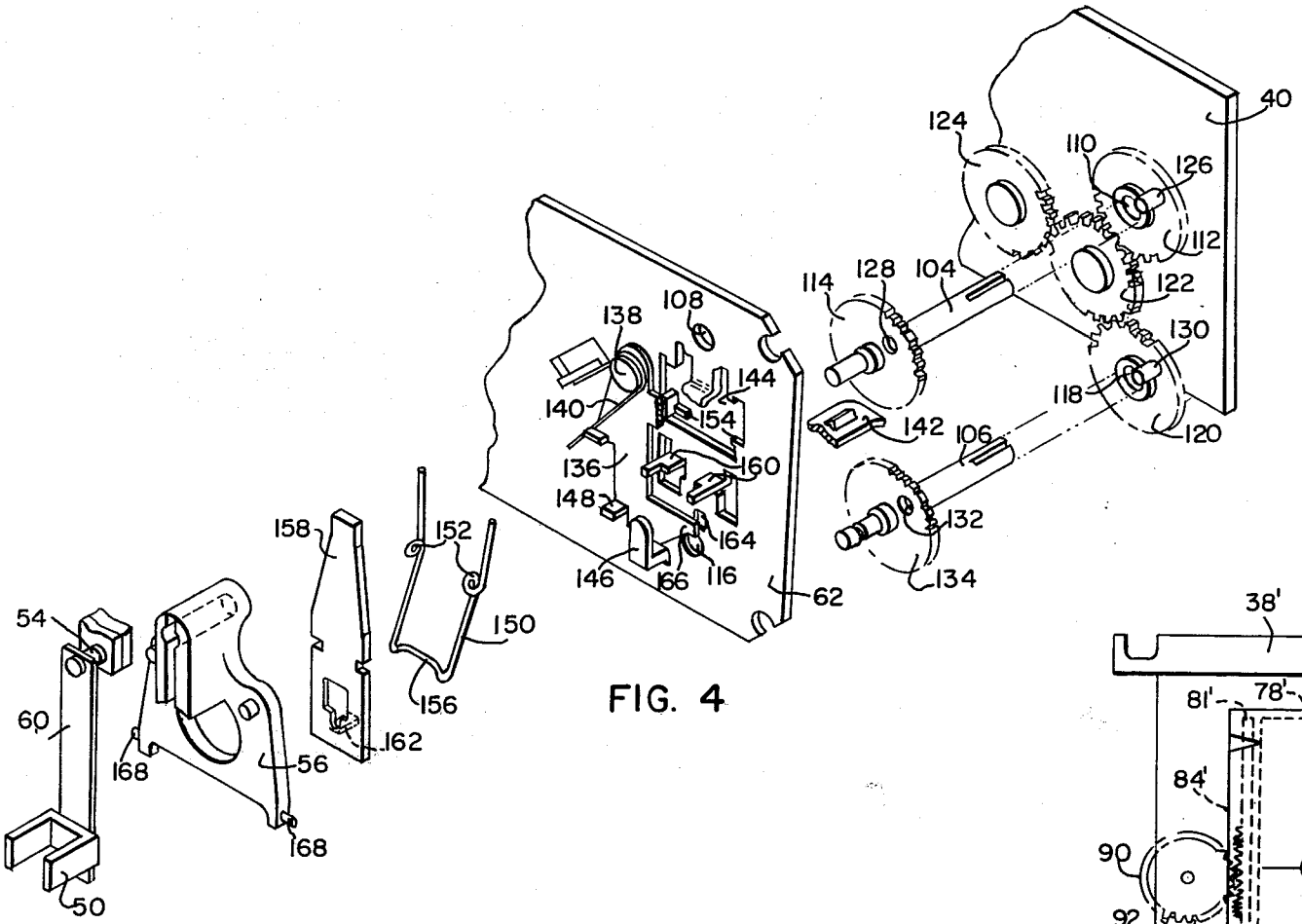
FIG. 4 is an exploded, partial view of the switch activating mechanism of an appliance timer constructed according to this invention.

FIG. 4 is an exploded view showing a portion to the timer 10. The start shaft 104 extends through the opening 108 in the supporting plate 62, the opening 110 in the gear 112, and through an opening in the supporting plate 40. The gear 114 is fixed to the shaft 104 and is rotated when the shaft 104 is rotated. The gear 112 does not rotate with the rotation of the shaft 104 since the opening 110 is slightly larger than the diameter of the shaft 104. Similarly, the stop shaft 106 extends through the opening 116, the opening 118 in the gear 120, and an opening in the supporting plate 40.

The gears 112, 120, 122 and 124 are all coupled together and are driven by the motor 64 through other gearing which normally rotates the gears 112 and 120 at the rate of one revolution every 12 hours. The nose 126 on the gear 112 may extend through the opening 128 in the gear 114 when the gears are properly aligned. Similarly, the nose 130 may extend through the opening 132 in the gear 134 when the gears are properly aligned.

The locking lever 136 is positioned around the pin or rivet 138 and is forced in a counterclockwise direction by the spring 140. The arm 142, which is broken-away for clarity, extends from the body portion of the locking lever 136 through the opening 144 in the supporting plate 62. The arm 142 is positioned against the gear 114 for part of the time during an operating sequence of the start-stop feature of the timer and limits the counterclockwise movement of the locking lever 136. The stop 146 and the ear 148 may contact each other to also limit the amount of counterclockwise movement of the locking lever 136.

The U-shaped spring 150 is positioned with the loops 152 around the projections 154 near the opening 144. The back portion 156 of the spring 150 extends over the rocking lever 158 which is positioned between the guides 160. The purpose of the spring 150 is to provide a force on the rocking lever 158 which acts toward the supporting plate 62. The rocking lever 158 includes an ear 162 which may extend into the opening 164 in the supporting plate 62 when this opening is not covered by the locking lever extension 166 and when the shafts 104 and 106 are in predetermined positions. The position of the rocking lever 158 determines the position of the switch operator 56 which pivots in the switch housing around the pins 168. The switch operator 56 controls the position of the electrical contacts, such as the contact 54.

Figure 5:
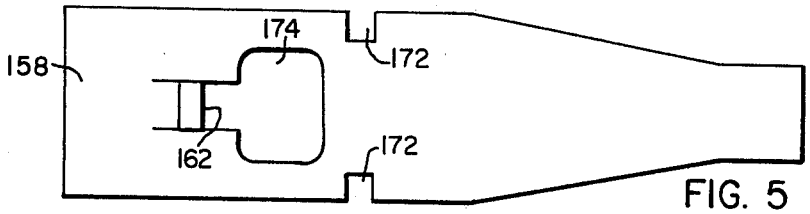
FIG. 5 is a plan view of a rocking lever constructed for use in the appliance timer.
Figure 6:
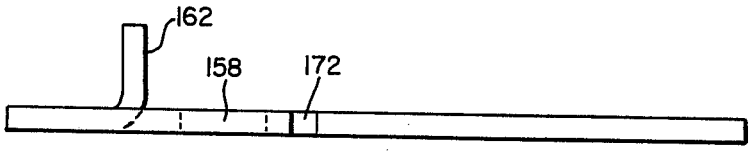
FIG. 6 is an elevational view of the rocking lever shown in FIG. 5.
Figure 7:
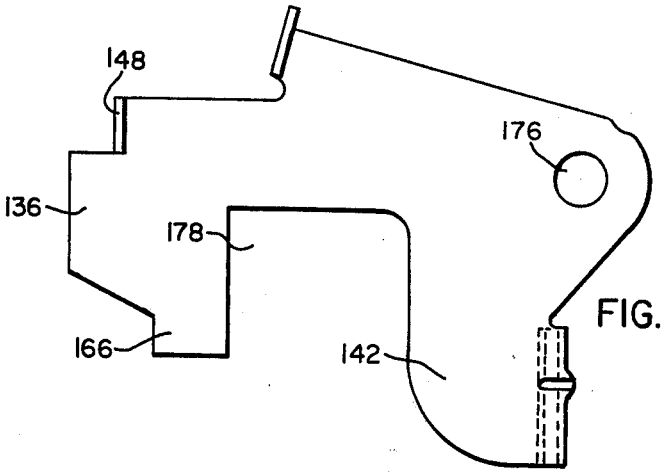
FIG. 7 is a plan view of a locking lever constructed for use in the appliance timer.
Figure 8:
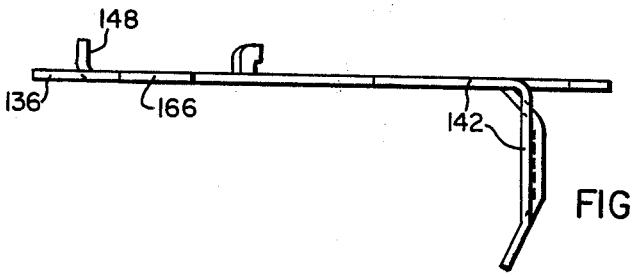
FIG. 8 is an elevational view of the locking lever shown in FIG. 7.

FIGS. 5, 6, 7 and 8 are views of the rocking lever 158 and the locking lever 136. As shown in FIGS. 5 and 6, an ear 162 projects from the flat portion of the rocking lever 158. The indentations 172 engage with the guides 160 on the supporting plate 62 to provide a pivot or fulcrum around which the lever 158 may rock. The ear 162 may be constructed conveniently by bending a portion of the material, which is removed to for the opening 174, around 90° with respect to its original orientation. As shown in FIGS. 7 and 8, the locking lever 136 includes the opening 176 which is located at the pivot position of the lever 136. The channel 178 formed by the extension 166 and the arm 142 provides space for the spring 150 and the guides 160 to extend beyond the surface of the supporting plate 62.

Figure 9:
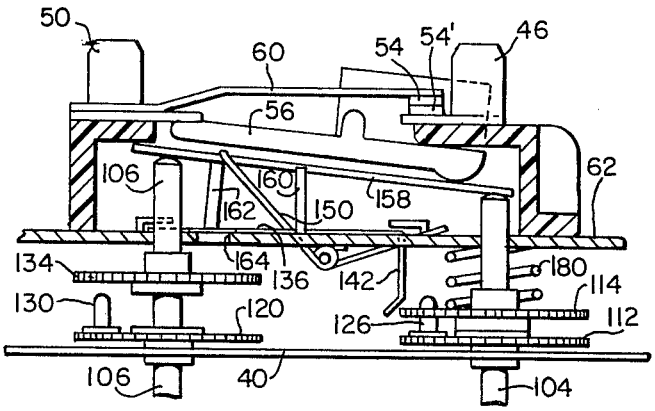
FIG. 9 is a sectional, elevational view of the switch activating mechanism shown in the manual position.

The operation of some portions of the appliance timer 10 would be apparent from a study of the referenced patents. FIGS. 9, 10, 11 and 12 illustrate the operations directly involving the rocking and locking levers. In FIG. 9, the illustrated components are in the position which they maintain when the stop shaft is pushed in to set the timer for manual operation. When the shaft 106 is pushed inwardly for manual operation of the associated appliance, the rocking lever 158 is moved upwardly on the left side of the guide 160. The switch operator 56 is in a lowered position, thus allowing the contacts 54 and 54' to be engaged.

For manual operation, it is desirable to maintain the position of the rocking lever 158 as shown in FIG. 9. This condition is obtained with the aid of the locking lever 136. As the shaft 106 is pushed in, the ear 162 retracts from the opening 164 in the supporting plate 62. Referring also to FIG. 4, when the ear 162 moves above the locking lever 136, the extension 166 thereon moves across the opening 164 because of the resilient action of the spring 140. Once the extension 166 of the locking lever 136 moves across the opening 164, the ear and the rocking lever 158 remain in the position shown in FIG. 9, regardless of the location of the shaft 106. Therefore, unless the shaft 104 is pushed, the contacts 54 and 54' remain engaged and the associated appliance can be operated manually.

The proper operation of the entire switch activating mechanism requires that the rocking lever 158 remain extended from the supporting plate 62 when set for manual operation. The position of the shaft 106 after moving the rocking lever 158 is not critical. With the embodiment shown in FIG. 9, the position of the rocking lever 158 is maintained directly with reference to the plane of the supporting plate 62, without intermediate members, such as the shaft 106 as used in some prior art arrangements.

Figure 10:
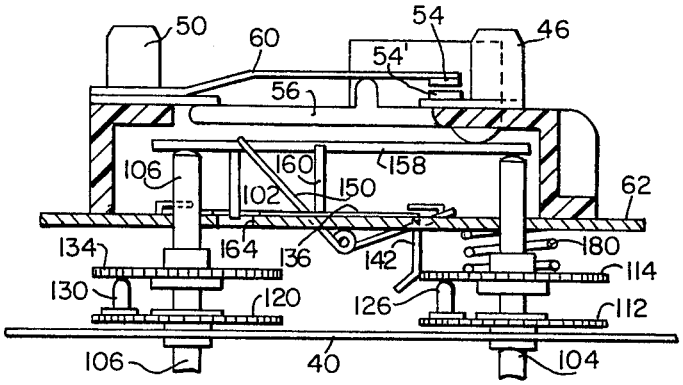
FIG. 10 is a sectional, elevational view of the switch activating mechanism shown in the automatic delay position.

Placing the contacts 54 and 54' in the disengaged position for an automatic delay, that is, to close at a later time, requires the pushing of the shaft 104 upwardly according to the orientation of FIGS. 9 and 10. As the shaft 104 is being pushed up the arm 142 is engaged by the gear 114 which moves with the shaft 104. This engagement moves the locking lever 136 and the extension 166 away from the opening 164, thus allowing the ear 162 to extend slightly into the opening 164. The movement of the lever 136 is restricted by the shaft 106 which is locked in an upward position since the nose 130 prevents closer positioning of the gears 120 and 134. Thus, the contacts 54 and 54' are disengaged when the shaft 104 is pushed in. The shaft 104 is locked in this position since the nose 126 prevents closer positioning of the gears 112 and 114 when the nose is not aligned with the opening 128 in the gear 114. This is always the case except when the actual time is the same as the time at which the start shaft 104 is set.

If the shaft 106 is not set at a position which corresponds to a turn-off time which is different than the actual time, the opening 132 in the gear 134 is aligned with the nose 130. This allows the shaft 106 to move down when the shaft 104 is pushed up, thereby allowing the rocking lever 158 to move up on the right side of the guide 160 regardless of the position of the shaft 104. This provides a safety feature since the contacts 54 and 54' cannot be closed automatically by any movement of the shaft 104 unless the stop shaft 106 has been placed in a position which will disengage the contacts 54 and 54' after some time interval. Thus, unless the timer is set to turn off at a predetermined time, it will not turn on at any predetermined time.

The gears 112 and 120 are rotatable by the clock mechanism of the timer and rotate at the rate of one revolution per 12-hour period. The orientation of the openings in the gears 114 and 134 with respect to the noses associated therewith determine the times at which the controls 54 and 54' will engage and disengage. For example, if an opening is advanced 90° from its corresponding nose, the condition of the contacts 54 and 54' would change after a period of 3 hours, that is, when the nose and the opening are aligned to allow the corresponding shaft to move up. The gears 112 and 120 rotate according to the actual time and the gears 114 and 134 are rotated manually to the desired starting and stopping times. The corresponding noses and openings are aligned when the actual time is the same as the time set for starting and stopping.

Figure 11:
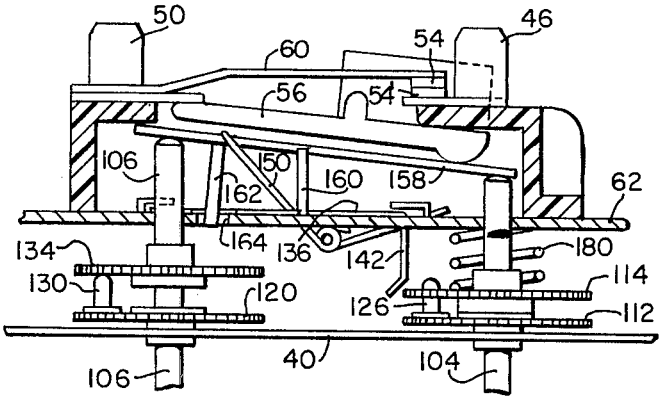
FIG. 11 is a sectional, elevational view of the switch activating mechanism shown in the automatic ON position; and, FIG. 12 is a sectional, elevational view of the switch activating mechanism shown in the automatic OFF position.

After being set for automatic operation, the nose 126 advances toward the opening 128 in the gear 114. When the nose 126 and the opening 128 are aligned at the preset starting time, the gears 112 and 114 are forced together by the spring 180 as shown in FIG. 11. This allows the lever 158 to move down on the right side of the guide 160 and permits the contacts 54 and 54' to engage and turn on the associated appliance. Although movement of the lever 136 is not restrained by the arm 142 when the gear 114 is in the downward position as shown in FIG. 11, the extension 166 does not move across the opening 164 since the ear 162 extends partly into the opening 164 and therefore blocks further movement of the locking lever 136. The shaft 104 may rotate with the gear 112 without changing the position of the rocking lever 158.

Figure 12:
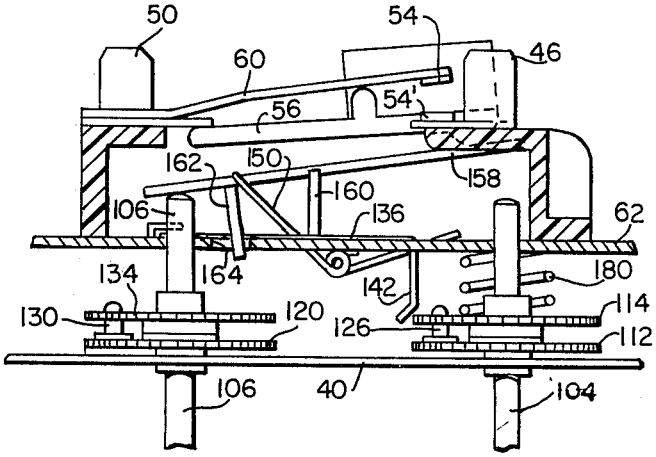

When the actual time equals the time at which the stop shaft 106 is set, the nose 130 is aligned with the opening 132 in the gear 134. As shown in FIG. 12, this permits the gears 120 and 134 to move together and the rocking lever 158 to move up on the right side of the guide 160, all due to the force provided by the spring 150. This disengages the contacts 54 and 54' and stops or turns off the associated appliance.

The arrangement disclosed herein for locking the position of the rocking lever 158 provides for positive support of the rocking lever 158 when in the position necessary to assure manual operation of the associated appliance. In addition, the shaft 106 may rotate with the motor-driven gear mechanism according to the correct time. A spring may be located around the shaft 106 between the gear 134 and the supporting plate 62 to keep the nose 130 engaged with the gear 134 during manual operation. This has the advantage that, during manual operation, the pointers for both the start and stop shafts will indicate the correct time.

Since numerous changes may be made in the above-described apparatus, and since different embodiments of this invention may be made without departing from the spirit thereof, it is intended that all of the matter contained in the foregoing description, or shown in the accompanying drawing, shall be interpreted as illustrative rather than limiting.

I claim as my invention:

1. A timing device suitable for electric ranges, comprising:

a supporting plate having at least first, second and third openings therein;

an electrical contact structure having opened and closed positions and supported in fixed relationship with respect to the supporting plate;

a rocking lever supported from the supporting plate, said rocking lever having first and second ends positioned substantially over the first and second openings in the supporting plate and an ear projecting from the surface of said lever and positioned substantially over the third opening;

a first shaft extending through the first opening in the supporting plate and engageable with the first end of the rocking lever;

a second shaft extending through the second opening in the supporting plate and engageable with the second end of the rocking lever;

a motor-driven gear mechanism;

said first and second shafts being settable in automatic and manual positions to provide automatic control of the contacts according to the position of the motor-driven gear assembly and to provide manual control of the contacts which is nonresponsive to the position of the motor-driven gear assembly;

a locking lever pivotally attached to the supporting plate;

means for moving a portion of the locking lever across the third opening when the first and second shafts are set in the manual position; and, means for moving the locking lever away from the third opening when the first and second shafts are set in the automatic position.

2. A timing device comprising:

a supporting plate;

an electrical contact structure having opened and closed positions and attached to the supporting plate;

operating means supported from the supporting plate for opening and closing the contacts of the contact structure;

moving means for moving the operating means, said moving means having a timed position in which the operation thereof is governed by a motor and drive assembly, thereby providing timed control of the contact structure by locking the operating means in a position which keeps the contacts open for a predetermined amount of time, and said moving means having a manual position in which the operation thereof is not dependent upon time, thereby providing manual control of the contact structure by locking the operating means in a position which keeps the contacts closed until the moving means is changed from the manual position;

a projection extending from said operating means and positioned to project through a first opening when the operating means is in a predetermined position, said first opening being positioned in the supporting plate and located substantially underneath the operating means; and, means for blocking the first opening when the moving means is in the manual position, thereby preventing the penetration of the projection into the first opening, said projection being located on the operating means in such a manner as to lock the operating means in the position which keeps the contacts closed when the projection cannot penetrate the first opening;

said blocking means including a locking plate which is attached to the supporting plate and is resiliently forced over the first opening when the projection is not in the first opening.

3. The timing device of claim 2 wherein the moving means includes first and second shafts which extend through additional openings in the supporting plate.

4. The timing device of claim 2 wherein the timing device also includes a guide member extending from the supporting plate, and wherein the operating means includes a lever which is engaged with the guide member, with the contacts of the contact structure being coupled to the lever.

5. The timing device of claim 4 wherein the projection from the operating means is an ear extending from the lever and directed toward the supporting plate.

6. The timing device of claim 2 including a digital clock display subassembly which is driven by said motor, said subassembly comprising a plurality of numbered cylinders which are interconnected to display the time of day, said subassembly having a single mechanical input and being suitable for attachment to other components of the timing device when mounted in either of two different positions, said positions being rotated 90° from each other.

7. A timing device suitable for electric ranges, comprising:

a supporting plate having at least first, second and third openings therein;

an electrical contact structure having opened and closed positions, said contact structure being supported by the supporting plate;

a rocking lever supported from the supporting plate, said rocking lever having first and second ends positioned substantially over the first and second openings in the supporting plate and an ear projecting from the surface of said lever and positioned substantially over the third opening;

a first shaft extending through the first opening in the supporting plate and engageable with the first end of the rocking lever;

a second shaft extending through the second opening in the supporting plate and engageable with the second end of the rocking lever;

a motor-driven gear mechanism;

said first and second shafts being settable in automatic and manual positions to provide automatic control of the contacts according to the position of the motor-driven gear assembly and to provide manual control of the contacts which is nonresponsive to the position of the motor-driven gear assembly;

a locking lever pivotally attached to the supporting plate;

means for moving a portion of the locking lever across the third opening when the first and second shafts are set in the manual position; and, means for moving the locking lever away from the third opening when the first and second shafts are set in the automatic position.

* * * * *